US011821292B2

(12) United States Patent
Johnson et al.

(10) Patent No.: US 11,821,292 B2
(45) **Date of Patent: *Nov. 21, 2023**

(54) APPARATUSES, SYSTEMS AND METHODS FOR HYDROCARBON MATERIAL FROM A SUBTERRANEAN FORMATION USING A DISPLACEMENT PROCESS

(71) Applicant: NCS Multistage, Inc., Calgary (CA)

(72) Inventors: Timothy Johnson, Calgary (CA); Masoud Kalantari, Calgary (CA)

(73) Assignee: NCS MULTISTAGE, INC., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/960,615

(22) Filed: Oct. 5, 2022

(65) Prior Publication Data

US 2023/0028424 A1 Jan. 26, 2023

Related U.S. Application Data

(63) Continuation of application No. 16/964,616, filed as application No. PCT/CA2019/050107 on Jan. 29, 2019, now Pat. No. 11,492,879.

(60) Provisional application No. 62/776,731, filed on Dec. 7, 2018, provisional application No. 62/624,033, filed on Jan. 30, 2018.

(51) Int. Cl.
*E21B 34/06* (2006.01)
*E21B 43/12* (2006.01)

(52) U.S. Cl.
CPC ..... *E21B 43/12* (2013.01); *E21B 34/06* (2013.01)

(58) Field of Classification Search
CPC ..... E21B 34/06; E21B 43/12
See application file for complete search history.

(56) References Cited

U.S. PATENT DOCUMENTS

| | | | |
|---|---|---|---|
| 2,280,788 | A | 4/1942 | Boynton |
| 4,295,795 | A | 10/1981 | Gass et al. |
| 4,432,416 | A | 2/1984 | Welch et al. |
| 5,937,945 | A | 8/1999 | Bussear et al. |
| 6,000,468 | A | 12/1999 | Pringle |
| 6,715,550 | B2 | 4/2004 | Vinegar et al. |
| 6,957,577 | B1 | 10/2005 | Firmin |

(Continued)

FOREIGN PATENT DOCUMENTS

| | | | |
|---|---|---|---|
| CA | 2948273 | A1 | 5/2017 |
| WO | 2001065056 | A1 | 9/2001 |
| WO | 2016181154 | A1 | 11/2016 |

*Primary Examiner* — Matthew R Buck
(74) *Attorney, Agent, or Firm* — Nolte Lackenbach Siegel

(57) ABSTRACT

There is provided a flow control apparatus configured for optimizing use of available space within the wellbore for conducting of fluids between the surface and the subterranean formation. The flow control apparatus is useable for conducting all forms of fluid, such as, for example, liquids, gases, or mixtures of liquids and gases. As well, the flow control apparatus is useable for effecting injection of fluid (e.g. a fluid for stimulating hydrocarbon production via a drive process, such as, for example, waterflooding, or via a cyclic process, such as "huff and puff") into the subterranean formation, and for receiving production of fluid (e.g. hydrocarbon material) from the subterranean formation (including production that is stimulated by gas lift).

20 Claims, 8 Drawing Sheets

(56) References Cited

U.S. PATENT DOCUMENTS

| | | | | |
|---|---|---|---|---|
| 8,752,629 | B2 * | 6/2014 | Moen | E21B 34/08 166/324 |
| 9,453,389 | B2 | 9/2016 | Anderson et al. | |
| 10,323,481 | B2 | 6/2019 | Pratt et al. | |
| 11,492,879 | B2 * | 11/2022 | Johnson | E21B 34/06 |
| 2008/0283238 | A1 * | 11/2008 | Richards | E21B 34/08 166/228 |
| 2009/0151925 | A1 * | 6/2009 | Richards | E21B 34/063 166/53 |
| 2015/0034323 | A1 | 2/2015 | Greene et al. | |
| 2015/0308238 | A1 * | 10/2015 | Langlais | E21B 43/04 166/278 |
| 2015/0369023 | A1 | 12/2015 | MacPhail et al. | |
| 2017/0130557 | A1 | 5/2017 | Pratt et al. | |
| 2019/0257173 | A1 | 8/2019 | Pratt et al. | |

* cited by examiner

APPARATUSES, SYSTEMS AND METHODS FOR HYDROCARBON MATERIAL FROM A SUBTERRANEAN FORMATION USING A DISPLACEMENT PROCESS

CROSS REFERENCE TO RELATED APPLICATION

The present application is a continuation and claims priority to U.S. application Ser. No. 16/964,616 filed Jul. 24, 2020, which was a 371 filing of International PCT/CA2019/050107 filed Jan. 29, 2019, and U.S. Application Ser. No. 62/776,731, filed Dec. 7, 2018, U.S. Application Ser. No. 62/624,033, filed Jan. 30, 2018, the contents of all of which are incorporated by reference herein in their entirety.

FIELD

The present relates to apparatuses, systems and methods for producing hydrocarbon material from the subterranean formation using a drive process.

BACKGROUND

Space limitations within wellbores affect the volumetric rate of fluid (e.g. injected frac fluid, produced hydrocarbons, etc.) that is flowable between the surface and a hydrocarbon-containing reservoir. These space limitations are exacerbated by downhole tools which are deployed within the wellbore. To increase the amount of space that is available to enable flowing of fluids within the wellbore, it is desirable to configure downhole tools so as not to unnecessarily occupy this valuable space.

SUMMARY

In one aspect, there is provided a flow control apparatus for disposition within a subterranean formation, comprising:

a housing;

a fluid conducting passage defined within the housing;

a flow communicator configured for effecting flow communication between the fluid conducting passage and the subterranean formation, wherein the flow communicator includes:

an orifice defined within a valve seat;

one or more ports defined within the outermost surface of the housing; and a space extending between the orifice and the one or more ports;

a flow control member displaceable relative to the valve seat between seated and unseated positions for controlling flow communication via the orifice; and a cutting tool coupled to the flow control member for translation with the flow control member;

wherein:

the flow control member and the cutting tool are co-operatively configured such that, while: (i) the flow control member is being displaced relative to the valve seat between the seated and the unseated positions, and (ii) solid debris is disposed within the space, the cutting tool effects size reduction of the solid debris, such that size-reduced solid debris is obtained.

In another aspect, there is provided a flow control apparatus for disposition within a subterranean formation, comprising:

a housing;

a fluid conducting passage defined within the housing;

a flow communicator configured for effecting flow communication between the fluid conducting passage and the subterranean formation, wherein the flow communicator includes:

an orifice defined within a valve seat;

one or more ports defined within the outermost surface of the housing; and a space extending between the orifice and the one or more ports;

a reciprocating assembly including a flow control member that is displaceable relative to the valve seat between seated and unseated positions for controlling flow communication via the orifice;

wherein:

the flow control member and a distal end of the reciprocating assembly are co-operatively configured such that while the flow control member is seated relative to the valve seat, the distal end, of the reciprocating assembly, extends through the orifice and into the space, while being spaced apart from the housing, and is spaced apart from the housing by a maximum distance of less than $^{3}/_{1000}$ of an inch.

In another aspect, there is provided a flow control apparatus for disposition within a subterranean formation, comprising:

a housing;

a fluid conducting passage defined within the housing;

a flow communicator for effecting flow communication between the fluid conducting passage and the subterranean formation;

a flow control member displaceable, relative to the flow communicator, between closed and open positions, for controlling flow communication between the fluid conducting passage and the flow communicator;

a hydraulic actuator for effecting the displacement of the flow control member;

wherein:

the hydraulic actuator includes:

working fluid;

a pump;

a first working fluid containing space;

a second working fluid containing space; and a piston each one of the first and second working fluid containing spaces, independently, is disposed in fluid pressure communication with the piston;

the working fluid, the pump, the piston, the first space, and the second space are co-operatively configured such that:

while the flow control member is disposed in one of the opened and closed positions, and the pump becomes disposed in the first mode of operation, the pump is receiving supply of working fluid from the first working fluid containing space and discharging pressurized working fluid into the second working fluid containing space, with effect that working fluid, within the second working fluid containing space, and in fluid pressure communication with the piston, becomes disposed at a higher pressure than working fluid within the first working fluid containing space and in fluid pressure communication with the piston, such that an unbalanced force is acting on the piston and effects movement of the piston, such that the flow control member is displaced to the other one of the opened position and the closed position; and while the flow control member is disposed in the other one of the opened position and the closed position, and the pump becomes disposed in the second mode of operation, the pump is receiving supply of working fluid from the second working fluid containing space and discharging pressurized working fluid into the first working fluid containing space, with effect that working fluid, within the first working fluid containing space and in fluid pressure communication with the piston, becomes disposed at a higher pressure than working fluid within the second space and in fluid pressure communication with the piston, such that an unbalanced force is acting on the piston and effects movement of the piston, such that the flow control member becomes disposed in the one of the opened position and the closed position;

a passage extends through the piston and joins two portions of one of the first working fluid containing space and the second working fluid containing space;

and the piston and the two portions of the one of the first working fluid containing space and the second working fluid containing space are co-operatively configured such that joinder of the two space portions is maintained while the piston is displaced between positions corresponding to opened and closed positions of the flow control member.

In another aspect, there is provided a flow control apparatus for disposition within a subterranean formation, comprising:

a housing;

a fluid conducting passage defined within the housing;

a flow communicator configured for effecting flow communication between the fluid conducting passage and the subterranean formation, wherein the flow communicator includes:

a port defined within the outermost surface of the housing; and a flow communication passage extending between the fluid-conducting passage and the port;

an orifice disposed within the flow communication passage between the fluid-conducting passage and the port. and defined within a valve seat;

a flow control member displaceable relative to the valve seat between seated and unseated positions for controlling flow communication via the orifice; and a tracer material source disposed within the space;

wherein:

the orifice defines a central axis;

the port defines a central axis; and the orifice and the port are co-operatively configured such that, while the flow control apparatus is oriented such that the central axis of the orifice is disposed within a horizontal plane, the central axis of the port is disposed at an acute angle of greater than 45 degrees relative to the horizontal plane.

In another aspect, there is provided a flow control apparatus for disposition within a subterranean formation, comprising:

a housing;

a fluid conducting passage defined within the housing;

a flow communicator for effecting flow communication between the fluid conducting passage and the subterranean formation;

a flow control member displaceable, relative to the flow communicator, for controlling flow communication between the fluid conducting passage and the flow communicator;

a hydraulic actuator for effecting the displacement of the flow control member;

wherein:

the hydraulic actuator includes:

a working fluid pressurizing assembly including:

a working fluid source containing working fluid;

a working fluid-containing space; and a pump fluidly coupled to the working fluid source for pressurizing the working fluid and discharging the working fluid to the working fluid-containing space;

and a piston the working fluid-containing space is disposed in fluid pressure communication with the piston; and the working fluid source, the pump, the working fluid-containing space, the piston, and the flow control member are co-operatively configured such that, while the pump is pressurizing and discharging the working fluid into the working fluid-containing space, movement of the piston is actuated, with effect that the flow control member is displaced relative to the flow communicator;

a working fluid supply compensator includes working fluid disposed in fluid pressure communication with the fluid-conducting passage; and a valve for controlling flow communication between the working fluid-pressurizing assembly and the working fluid supply compensator, and configured for opening when the pressure of the working fluid within the working fluid-containing space becomes disposed below the pressure of the working fluid within the working fluid compensator.

DETAILED DESCRIPTION

Figure 1A:
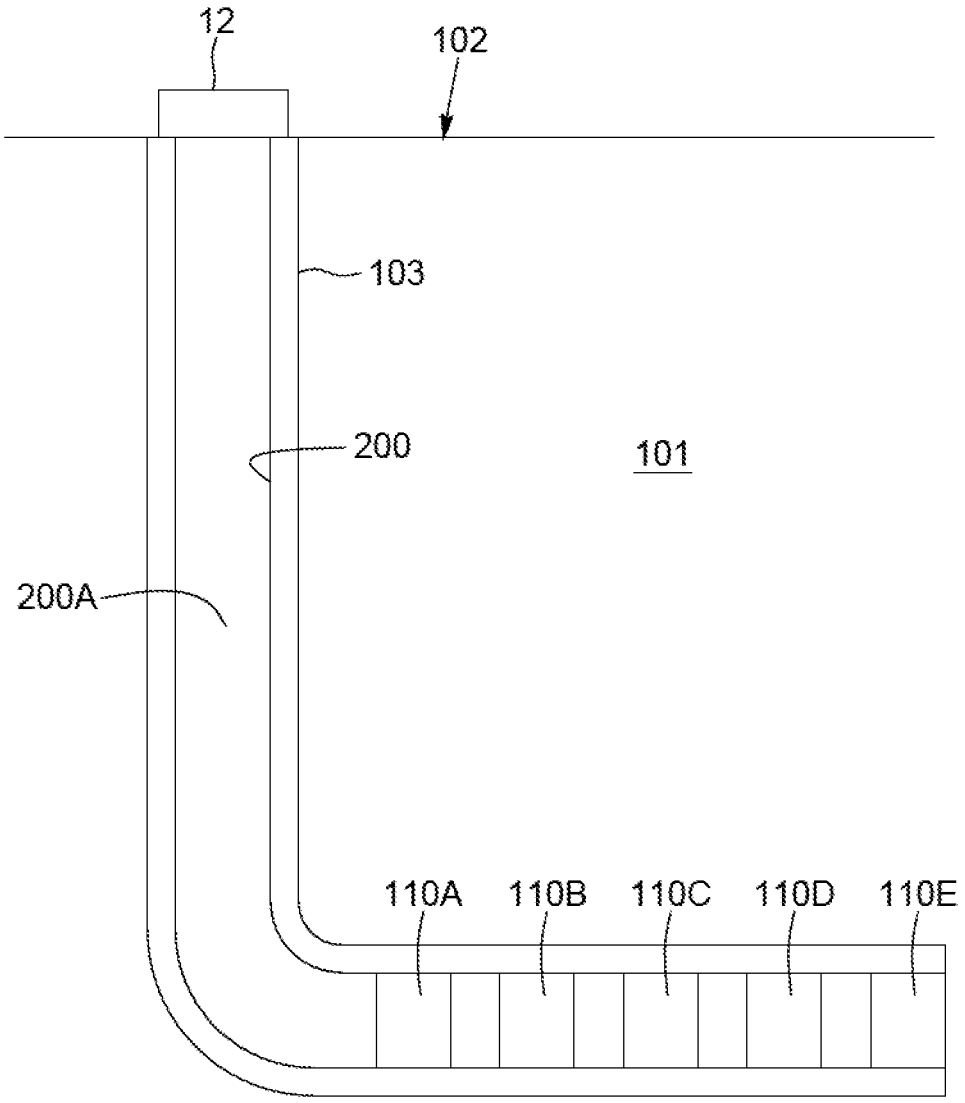
FIG. 1A is a schematic illustration of an embodiment of a downhole system of the present disclosure.

Referring to FIG. 1A, this relates to a flow control apparatus for downhole deployment within a wellbore 103 that extends from the surface 102 and into a subterranean formation 101. The flow control apparatus 202 is intended for integration within a wellbore string 200 that is emplaced within the wellbore 103. The integration may be effected, for example, by way of threading or welding.

Amongst other things, the flow control apparatus 202 is configured for optimizing use of available space within the wellbore 103 for conducting of fluids between the surface 102 and the subterranean formation 101. The flow control apparatus is useable for conducting all forms of fluid, such as, for example, liquids, gases, or mixtures of liquids and gases. As well, the flow control apparatus is useable for effecting injection of fluid (e.g. a fluid for stimulating hydrocarbon production via a drive process, such as, for example, waterflooding, or via a cyclic process, such as "huff and puff") into the subterranean formation 101, and for receiving lift gas for enhancing production by gas lift.

The wellbore 103 can be straight, curved, or branched and can have various wellbore sections. A wellbore section is an axial length of a wellbore. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

The wellbore string 200 defines a wellbore string passage 200A for conducting fluid between the surface 102 and the subterranean formation 101. Flow communication between the wellbore string 200 and the subterranean formation 101 is effected via one or more flow communication stations (five (5) flow communications 110A-E are illustrated). Successive flow communication stations may be spaced from each other along the wellbore such that each one of the flow communication stations 110A-E, independently, is positioned adjacent a zone or interval of the subterranean formation 101 for effecting flow communication between the wellbore string 200 and the zone (or interval).

For effecting the flow communication between the wellbore string 200 and the subterranean formation 101, each one of the flow communication stations 110A-E, includes a respective flow control apparatus 202.

Figure 2:
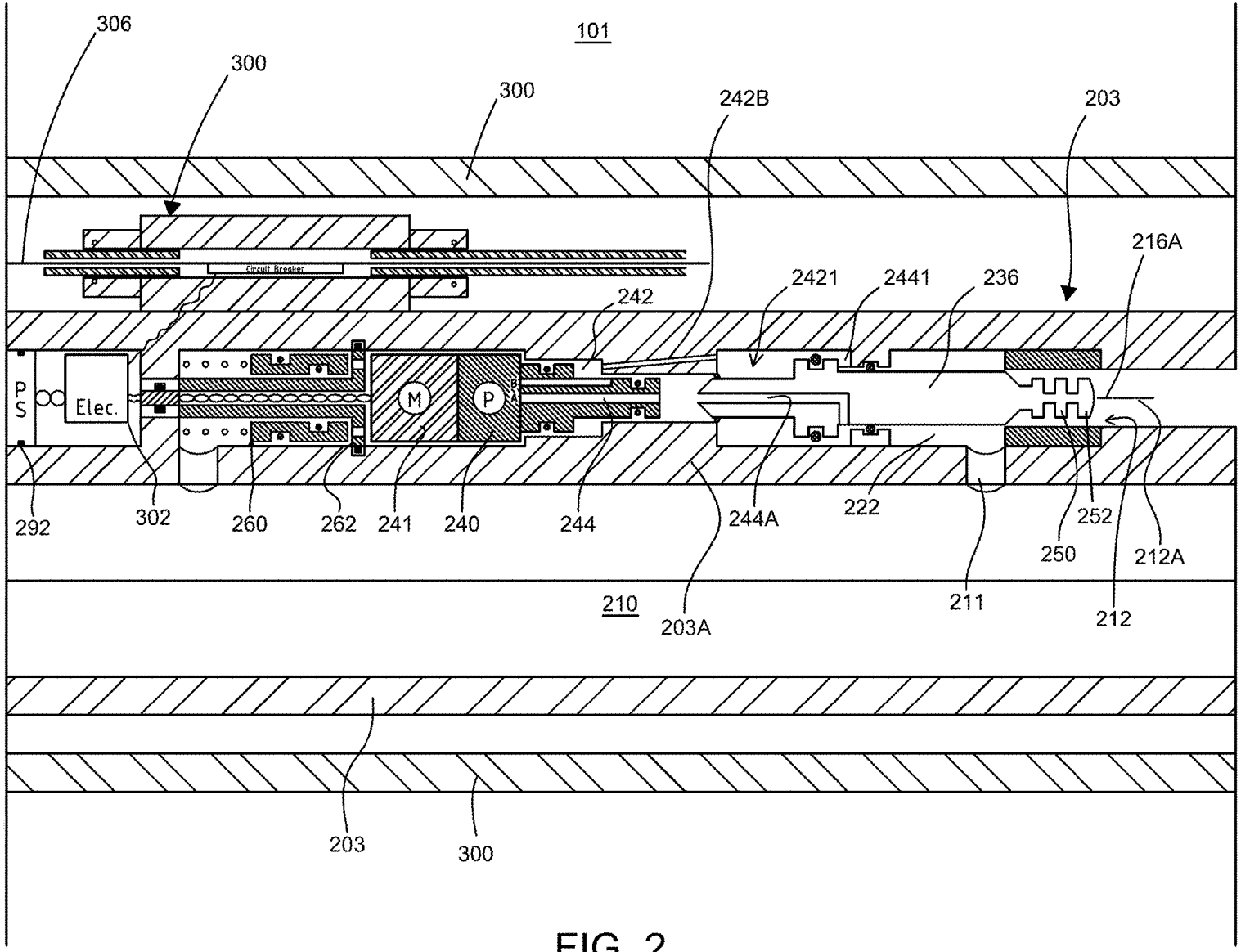
FIG. 2 is a schematic illustration of a flow control apparatus for use in the system illustrated in FIGS. 1A and 1B, showing the flow communicator in a closed condition.
Figure 3:
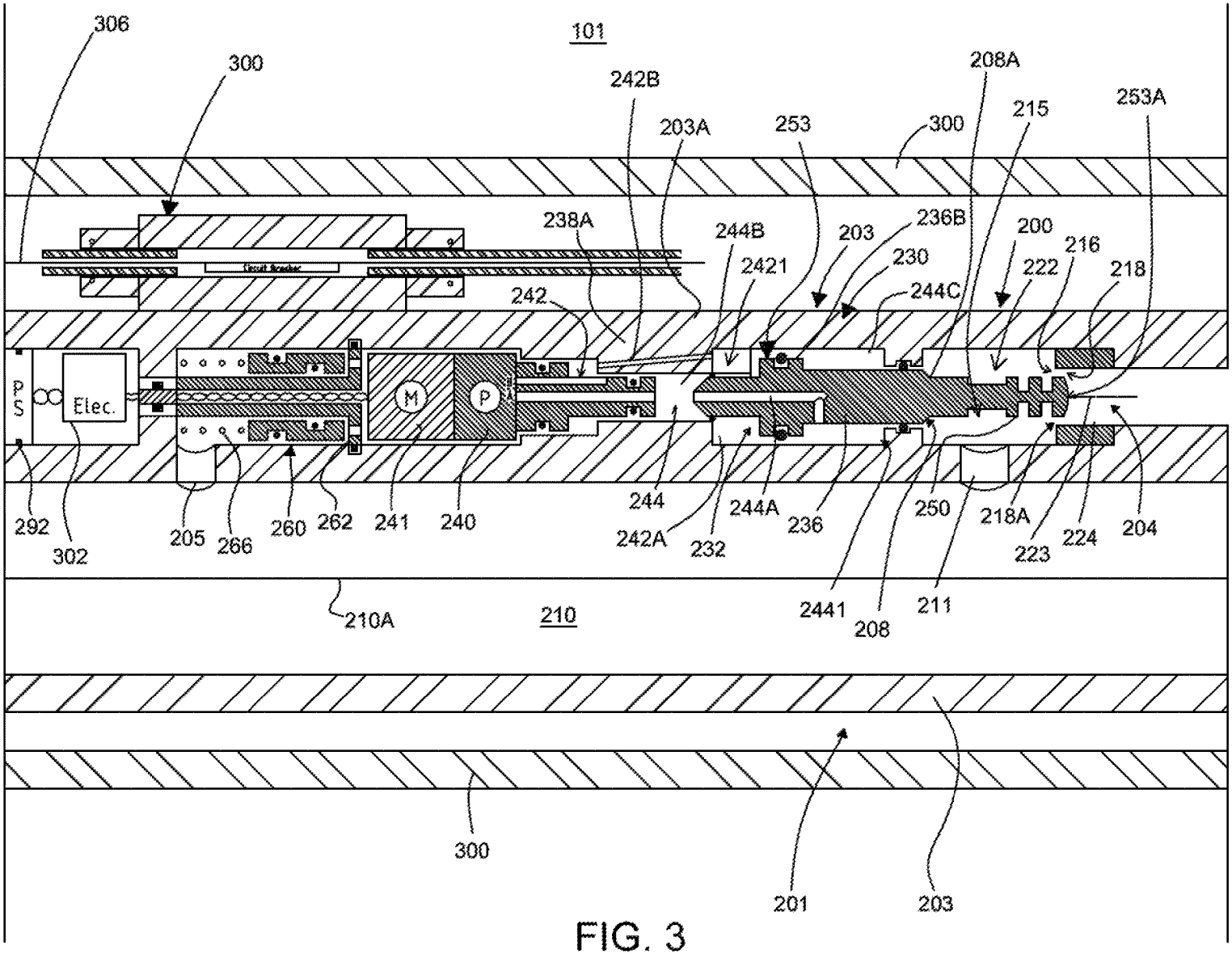
FIG. 3 is a schematic illustration of a flow control apparatus for use in the system illustrated in FIGS. 1A and 1B, showing the flow communicator in an opened condition.

Referring to FIGS. 2 and 3, the flow control apparatus 202 includes a housing 203. The housing 203 defines a fluid conductor 201. The fluid conductor 201 includes a fluid passage housing 203A that defines a fluid passage 210 for effecting conduction of fluid through the flow control apparatus 202 while the flow control apparatus 202 is integrated within the wellbore string 200. In this respect, the fluid passage 210 forms part of the wellbore string passage 200A.

The housing 203 also defines a flow communicator 204 through which the flow communication is effectible. The housing 203, the flow communicator 204, and the fluid conductor 205 are co-operatively disposed such that flow communication is effectible, via the flow communicator 204, between the fluid conductor 201 and the subterranean formation 101 that is external to the flow control apparatus 202. In some embodiments, for example, the subterranean formation flow communicator 204 includes one or more ports 212 defined within the outermost surface of the housing 203.

The flow control apparatus 202 also includes a flow control member 208. The flow control member 208 is configured for controlling the flow of material, via the flow communicator 204, between the fluid conductor 205 and the subterranean formation 101. In this respect, the flow control member is configured for controlling the material flow through the flow communicator 218.

The flow control member 208 is displaceable relative to the flow communicator 204 for effecting opening and closing of the flow communicator 204. In this respect, the flow control member 208 is displaceable between a closed position to an open position. The open position corresponds to an open condition of the flow communicator 204. The closed position corresponds to a closed condition of the flow communicator 204. For each one of the flow communication stations 110A-E, independently, an open condition of the flow communication station corresponds to the open condition of the respective flow communicator 204. For each one of the flow communication stations 110A-E, independently, a closed condition of the flow communication station corresponds to the closed condition of the respective flow communicator 204

The flow control member 208 is configured for opening a closed flow communicator 204. In some embodiments, for example, the opening of the flow communicator 204 effects a reduction in the portion of the flow communicator 204 being occluded by the flow control member 208. The flow control member 208 is also configured for closing a fully opened, or partially opened, flow communicator 204. In some of these embodiments, for example, the closing of the flow communicator 204 effects an increase in the portion of the flow communicator 204 being occluded by the flow control member 208

The flow communicator 204 is configured for disposition in a closed condition and an open condition.

In some embodiments, for example, while the flow communicator 204 is disposed in the closed condition, the flow control member 208 and the flow communicator 204 are co-operatively disposed in a closed configuration, and, in the closed configuration, the flow control member 208 is occluding the flow communicator 204. In some embodiments, for example, in the closed configuration, the flow control member 208 and the flow communicator 204 are co-operatively disposed such that flow communication, between the wellbore string passage 200A and the subterranean formation 101, is sealed or substantially sealed. In this respect, conduction of material between the wellbore string 200 and the subterranean formation 101, via the respective flow communication station is prevented, or substantially prevented.

In some embodiments, for example, while the flow communicator 204 is disposed in the open condition, the flow controller 224 and the flow communicator 204 are co-operatively disposed in an open configuration, and, in the open configuration, less than the entirety of the flow communicator 204 is occluded by the flow control member 208. In some of these embodiments, for example, a portion of the flow communicator 204 is occluded by the flow control member 208, and there is an absence of occlusion of at least another portion of the flow communicator 204 by the flow control member 208, such that the flow communicator 204 is disposed in a partially opened condition. In other ones of these embodiments, for example, there is an absence occlusion of any portion, or substantially any portion, of the flow communicator 204 by the flow control member 208, such that the flow communicator 204 is disposed in the fully opened condition. In this respect, the open condition includes both of the partially opened condition and the fully opened condition.

In some embodiments, for example, the flow control member 208 is displaceable by a shifting tool. In some embodiments, for example, the flow control member is displaceable in response to receiving of an actuation signal (such as, for example, by actuation by a hydraulic pump).

Figure 1B:
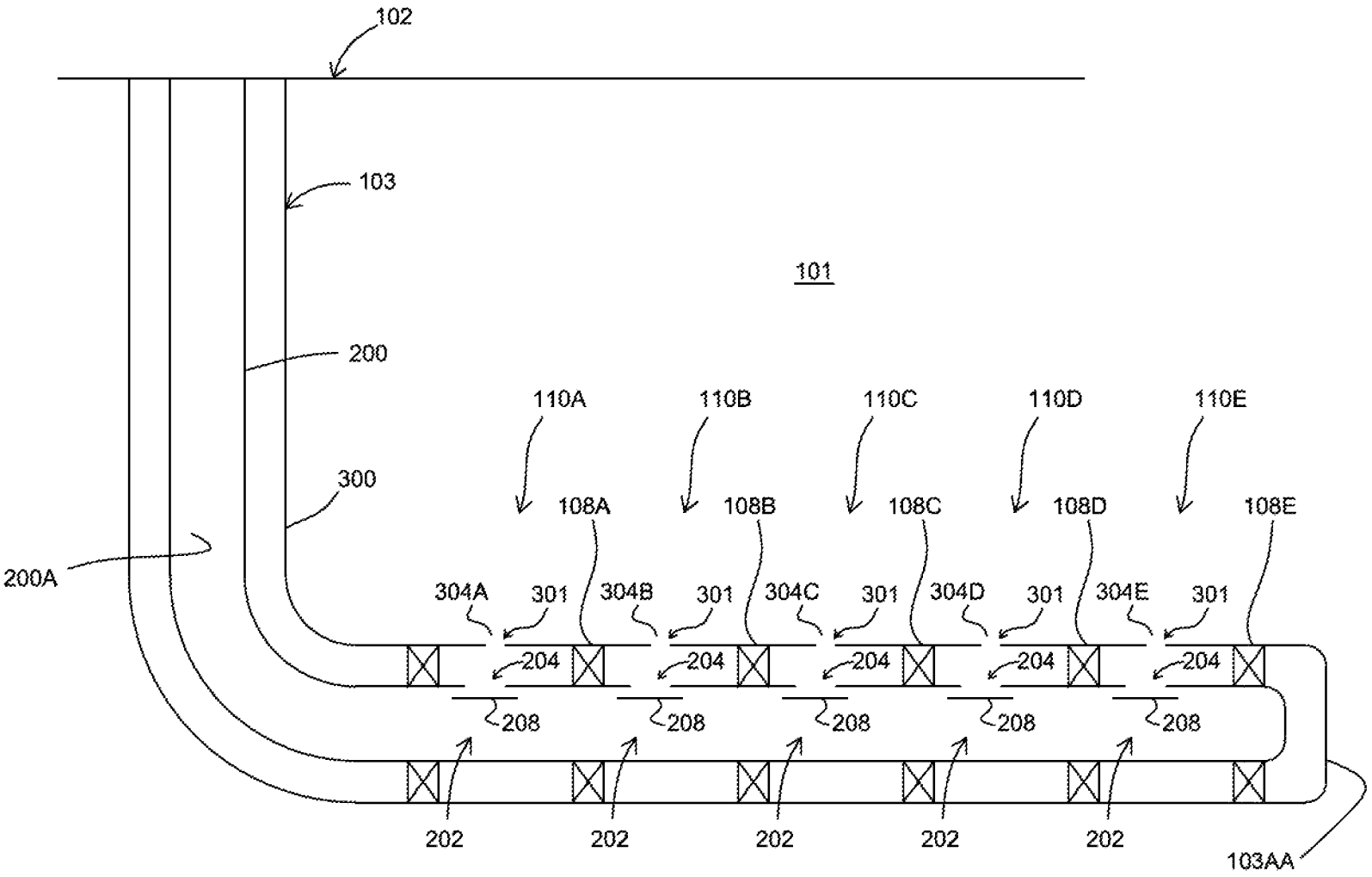
FIG. 1B is another schematic illustration of the system shown in FIG. 1A.

Referring to FIG. 1B, in some embodiments, for example, the wellbore 103 includes a cased-hole completion. In such embodiments, the wellbore 103 is lined with casing 300.

A cased-hole completion involves running casing 300 down into the wellbore 103 through the production zone. The casing 300 at least contributes to the stabilization of the subterranean formation 101 after the wellbore 103 has been completed, by at least contributing to the prevention of the collapse of the subterranean formation 101 that is defining the wellbore 101. In some embodiments, for example, the casing 300 includes one or more successively deployed concentric casing strings, each one of which is positioned within the wellbore 103, having one end extending from the wellhead 12. In this respect, the casing strings are typically run back up to the surface. In some embodiments, for example, each casing string includes a plurality of jointed segments of pipe. The jointed segments of pipe typically have threaded connections.

In some embodiments, for example, it is desirable to seal an annulus, formed within the wellbore, between the casing string and the subterranean formation. Sealing of the annulus is desirable for mitigating versus conduction of the fluid, being injected into the subterranean formation, into remote zones of the subterranean formation and thereby providing greater assurance that the injected fluid is directed to the intended zone of the subterranean formation.

To prevent, or at least interfere, with conduction of the injected fluid through the annulus, and, perhaps, to an unintended zone of the subterranean formation that is desired to be isolated from the formation fluid, or, perhaps, to the surface, the annulus is filled with a zonal isolation material. In some embodiments, for example, the zonal isolation material includes cement, and, in such cases, during installation of the assembly within the wellbore, the casing string is cemented to the subterranean formation 101, and the resulting system is referred to as a cemented completion.

In some embodiments, for example, the zonal isolation material is disposed as a sheath within an annular region between the casing 300 and the subterranean formation 101. In some embodiments, for example, the zonal isolation material is bonded to both of the casing 300 and the subterranean formation 101. In some embodiments, for example, the zonal isolation material also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing 300, and (d) at least contributes to the support of the casing 300.

In those embodiments where the wellbore 103 includes a cased completion, in some of these embodiments, for example, the casing includes the plurality of casing flow communicators 304A-E, and for each one of the flow communication stations 110A-E, independently, the flow communication between the wellbore 103 and the subterranean formation 101, for effecting the injection of the production-stimulating material, is effected through the respective one of the casing flow communicators 304A-E. In some embodiments, for example, each one of the casing flow communicators 304A-E, independently, is defined by one or more openings 301. In some embodiments, for example, the openings are defined by one or more ports that are disposed within a sub that has been integrated within the casing string 300, and are pre-existing, in that the ports exists before the sub, along with the casing string 300, has been installed downhole within the wellbore 103. Referring to FIG. 2, in some embodiments, for example, the openings are defined by perforations 301 within the casing string 300, and the perforations are created after the casing string 300 has been installed within the wellbore 103, such as by a perforating gun. In some embodiments, for example, for each one of the flow communication stations 110A-E, independently, the respective one of the casing flow communicator 304A-E is disposed in alignment, or substantial alignment, with the flow communicator 204 of the respective one of the flow communication stations 110A-E.

In this respect, in those embodiments where the wellbore 103 includes a cased completion, in some of these embodiments, for example, for each one of the flow communication stations 110A-E, independently, flow communication, via the flow communication station, is effectible between the surface 102 and the subterranean formation 101 via the wellbore string 200, the respective flow communicator 204, the annular space 104B within the wellbore 103 between the wellbore string 200 and the casing string 300, and the respective one of the casing string flow communicators 304A-E.

In some embodiments, for example, for each one of the adjacent flow communication stations, independently, a sealed interface is disposed within the wellbore 103 for preventing, or substantially preventing, flow communication, via the wellbore 103, between adjacent flow communication stations. In this respect, with respect to the embodiment illustrated in FIG. 1, sealed interfaces 108A-D are provided. In some embodiments, for example, the sealed interface is established by a packer. In those embodiments where the completion is a cased completion, in some of these embodiments, for example, the sealed interface extends across the annular space between the wellbore string 200 and the casing string 300.

In some embodiments, for example, with respect to the flow communication station that is disposed furthest downhole (i.e. flow communication station 110E), a further sealed interface 108E is disposed within the wellbore 103 for preventing, or substantially preventing, flow communication between the flow communication station 110E and a downhole-disposed portion 103AA of the wellbore 103.

Referring again to FIGS. 2 and 3, the housing 203A contains a valve subassembly 230. The valve subassembly 230 is provided for controlling flow communication between the fluid passage 210 and the subterranean formation 101. In this respect, the valve subassembly 230 includes a valve subassembly housing 203A that defines the flow communicator 204 and contains the flow control member 208. The housing 203A is mounted to the housing 203.

The flow communicator 204 further includes an orifice 216 disposed within a space 222 (e.g. a passage) between the fluid passage 210 and the one or more ports 212, such that flow communication between the fluid passage 210 and the one or more ports 212 (and, therefore, the subterranean formation 101) is effectible via the orifice 216.

The orifice 216 is defined within a valve seat 218. In some embodiments, for example, the valve seat 218 is defined within a manifold of the housing 203B. The valve seat 218 is configured for receiving seating of the flow control member 208 (such that the flow control member 208 becomes disposed in the closed position) for effecting disposition of the injection string flow communicator 204 in the closed condition. Referring to FIG. 3, while the flow control member 208 is spaced apart from the valve seat 218, the flow control member 208 is disposed in the open position, and, correspondingly, flow communication is established between the fluid passage 210 and the one or more ports 212 via the orifice 216, a fluid passage 215 (defined within the housing 203A, and extending transversely relative to the central axis 216A of the orifice 216), and a port 211 defined within an inner fluid passage-defining surface of the housing 203A, such that the flow communicator 204 is disposed in the open condition. The port 211 is fluidly coupled to the orifice 216 with the fluid passage 215, defined within the housing 203A, such that the port 211 effects flow communication between the fluid passage 210 and the orifice 216. The central axis of the port 211 extends transversely relative to the central axis 216A of the orifice 216, In some embodiments, for example, the flow control member 208 includes a seat-engaging surface 208A for seating on a seating surface 218A defined by the valve seat 218 (see FIG. 2), such that the flow communicator 204 becomes disposed in the closed condition. In some embodiments, for example, the material of the seat engaging surface 208A is nickel aluminum bronze and the material of the seating surface 218A is QPQ-nitrided 17-4PH stainless steel.

The orifice 216 has the central axis 216A, and the fluid passage 210 defines a central longitudinal axis 210A. In some embodiments, for example, the orifice 216 and the fluid passage 210 are co-operatively configured such that, while the flow control apparatus 202 is oriented such that the central axis 216A is disposed within a horizontal plane, the central longitudinal axis 210A is disposed at an acute angle of less than 45 degrees relative to the horizontal plane, such as, for example, at an acute angle of less than 22.5 degrees relative to the horizontal plane, such as, for example at an acute angle of less than 10 degrees relative to the horizontal plane. In some embodiments, for example, the orifice 216 and the fluid passage 210 are co-operatively configured such that, while the flow control apparatus 202 is oriented such that the central axis 216A is disposed within a horizontal plane, the central longitudinal axis 210A is parallel, or substantially parallel, to the horizontal plane.

In some embodiments, for example, the orifice 216 defines a central axis 216A, and each one of the one or more ports 212, independently, define a central axis 212A. In some embodiments, for example, the orifice 216 and the one or more ports 212 are co-operatively configured such that, while the flow control apparatus 202 is oriented such that the central axis 216A is disposed within a horizontal plane, the central axis 212A is disposed at an acute angle of less than 45 degrees relative to the horizontal plane, such as, for example, at an acute angle of less than 22.5 degrees relative to the horizontal plane, such as, for example at an acute angle of greater than 10 degrees relative to the horizontal plane. In some embodiments, for example, the orifice 216 and the one or more ports 212 are co-operatively configured such that, while the flow control apparatus 202 is oriented such that the central axis 216A is disposed within a horizontal plane, the central axis 212A is parallel to the horizontal plane.

In some embodiments, for example, a tracer material source 224 is disposed within the space 222. The tracer material source 224 is configured for releasing tracer material into production-stimulating material that is flowing past the tracer material source 224, while being injected into the subterranean formation 101 via the flow communicator 204, for monitoring by a sensor within the system 100 to provide information about the process. By virtue of the above-described co-operative orientation of the fluid passage 210, the orifice 216, and the one or more of the ports 212, there is an opportunity to increase the volume of the space 222 disposed between the fluid passage 210 and the one or more ports 212 without impacting, or without at least significantly impacting, on the space available within the apparatus 210 for defining the fluid passage 210. In this respect, the space 222 could be made larger for accommodating a larger quantity of tracer material.

In some embodiments, for example, the valve subassembly 230 further includes an actuator 232 for effecting displacement of the flow control member 208 relative to the valve seat 218. In some embodiments, for example, the flow control member 208 is mounted to the actuator 232.

In some embodiments, for example, the actuator 232 is a linear actuator, and is disposed for movement along a linear axis, such that the flow control member 208, correspondingly, is also disposed for movement along the linear axis. In some embodiments, for example, this axis of travel is parallel, or substantially parallel, to the central axis 216A of the orifice 216 (and, in some embodiments, for example, the travel is along an axis that is co-incident, or substantially co-incident, with the central axis 216A of the orifice 116).

In some embodiments, for example, seating of the flow control member 208 relative to the valve seat 218 (see FIG. 2) is effected by extension of the linear actuator 232 towards the valve seat 218 to an extended position, and unseating of the flow control member 208 relative to the valve seat 218 is effected by retraction of the linear actuator 232 relative to the valve seat 218 to a retracted position. In some embodiments, for example, the linear actuator 232 is configured to reciprocate between the extended (FIG. 2) and retracted positions (FIG. 3).

In some embodiments, for example, the linear actuator 232 is a hydraulic actuator that includes working fluid and a piston 236, with the working fluid being disposed in fluid pressure communication with the piston 236. In some embodiments, for example, the working fluid is an hydraulic oil. Relatedly, the valve sub-assembly housing 203B is configured for containing the working fluid. The housing 203B, the working fluid, and the piston 236 are co-operatively configured such that, in response to pressurizing of the working fluid 236, an unbalanced force is established and exerted on the piston 236 for urging movement of the piston 236, with effect that the flow control member 208 is displaced relative to the valve seat 218. In some embodiments, for example, the hydraulic actuator 232 has a first mode of operation and a second mode of operation, and, in the first mode of operation, the establishment of an unbalanced force is with effect that seating of the flow control member 208, relative to the valve seat 218, is effected (see FIG. 2), and, in the second mode of operation, the establishment of an unbalanced force is with effect that unseating of the flow control member 208, relative to the valve seat 218, is effected (see FIG. 3). In some embodiments, for example, the hydraulic actuator 232 further includes a bi-directional pump 240 which is operable in the first and second modes of operation in co-operation with a bi-directional motor 241 that is electrically coupled, via a eight (8) pin connector 302, to a power supply 300, extending externally, of the injection string 200, in the form of a power and communications cable 306.

In those embodiments where the hydraulic actuator 232 includes a bi-directional pump 240, in some of these embodiments, for example, a first working fluid-containing space 242 and a second working fluid-containing space 244 are disposed within the housing 203A. Each one of the spaces 242, 244, independently, is disposed in fluid pressure communication with the piston 236.

The housing 203A, the bidrectional pump 240, the first space 242, and the second space 244 are co-operatively configured such that, while the flow control member 208 is seated relative to the valve seat 218, and the bidrectional pump 240 becomes disposed in the first mode of operation, the bidrectional pump 240 is receiving supply of working fluid from the first space 242 and discharging pressurized working fluid into the second space 244, with effect that working fluid, within the second space 244, and in fluid pressure communication with the piston 236, becomes disposed at a higher pressure than working fluid within the first space 242 and in fluid pressure communication with the piston 236, such that an unbalanced force is acting on the piston 236 and effects retraction of the piston 236 relative to the valve seat 218, such that the flow control member 208 becomes unseated relative to the valve seat 218 and thereby effecting flow communication between the fluid passage 210 and the subterranean formation via the flow communicator 204.

The housing 203A, the bidrectional pump 240, the first space 242, and the second space 244 are further co-operatively configured such that, while the flow control member 208 is unseated relative to the valve seat 218, and the bidrectional pump 240 becomes disposed in the second mode of operation, the bidrectional pump 240 is receiving supply of working fluid from the second space 244 and discharging pressurized working fluid into the first space 242, with effect that working fluid, within the first space 242 and in fluid pressure communication with the piston 236, becomes disposed at a higher pressure than working fluid within the second space and in fluid pressure communication with the piston, such that an unbalanced force is acting on the piston 236 and effects extension of the piston 236 relative to the valve seat 218, such that the flow control member 208 becomes seated relative to the valve seat 218, with effect that the flow communicator 204 becomes disposed in the closed condition.

In some embodiments, for example, the first space 242 is disposed for fluid coupling with a working fluid supply compensator 260, in response to the pressure of the working fluid within the first space 242 becoming disposed below a minimum predetermined pressure. Similarly, in some embodiments, for example, the second space 244 is disposed for fluid coupling with a working fluid supply compensator 260, in response to the pressure of the working fluid within the second space 244 becoming disposed below a minimum predetermined pressure. This is to ensure that working fluid is being supplied from the discharge of the pump 240 at a sufficient pressure for acting on the piston 236 and overcoming the force applied by the production-stimulating material within the space 222 for resisting movement of the piston 236, and thereby effecting extension and retraction of the piston 236.

The working fluid supply compensator 260 includes working fluid disposed at a pressure of at least the pressure of the production-stimulating material disposed within the fluid passage 210. In this respect, the working fluid within the working fluid supply compensator 260 is disposed in fluid pressure communication with the production-stimulating material disposed within the fluid passage 210, such as via a moveable piston 262 that is sealingly disposed within the working fluid supply compensator 260. In some embodiments, for example, the pressure of the production-stimulating material disposed within the fluid passage 210. is between 0 psig and 10,000 psig.

The production-stimulating material is communicated from the fluid passage 210 via a port 205 disposed within the inner surface of the housing 203A, such that the working fluid within the working fluid supply compensator 260 is disposed at the same, or substantially the same, pressure as the production-stimulating material within the fluid passage 210. In some embodiments, for example, a resilient member, such as spring 266, is disposed within the compensator 260 and biases the piston 262 towards the working fluid for creating a pre-load on the working fluid, and this is useful during start-up to prevent cavitation. In this respect, the pressure of the working fluid is equivalent to about the sum of the pressure of the production-stimulating material within the fluid passage 210 and that attributable to the spring force.

Figure 4:
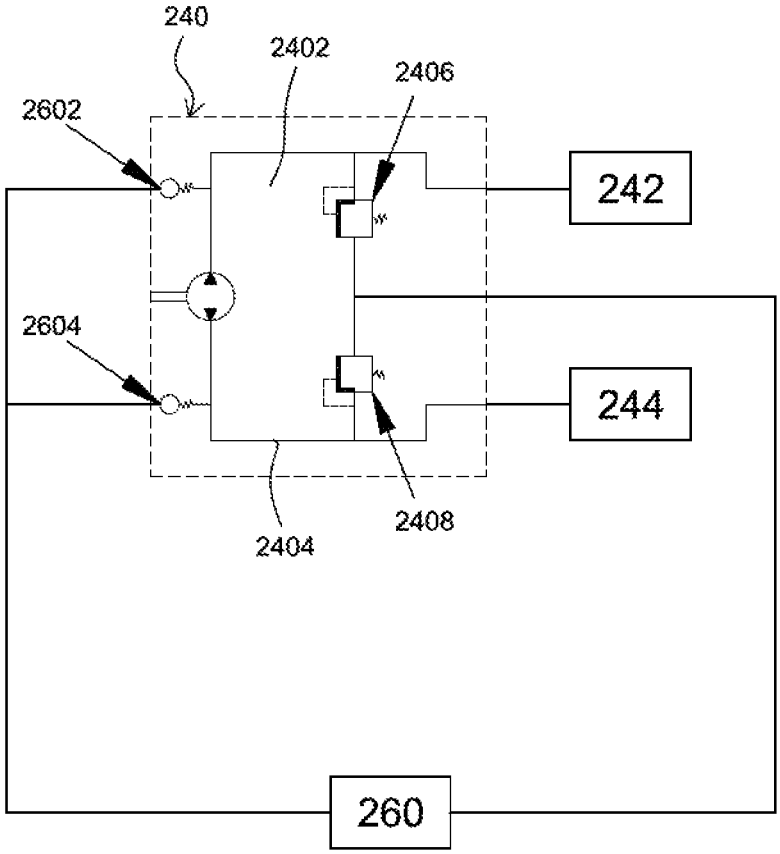
FIG. 4 is a schematic illustration of the flow communication between the bi-directional pump, the first and second working fluid-containing spaces, and the working fluid supply compensator.

Referring to FIG. 4, a one-way valve 2602 (such as, for example, a check valve) is provided for controlling flow communication with the working fluid supply compensator 260, and is configured for opening in response to the pressure of the working fluid within the first space 242 becoming disposed below the pressure of the working fluid within the working fluid compensator 260. Similarly, a one-way valve 2604 (such as, for example, a check valve) is provided for controlling flow communication with the working fluid supply compensator 260, and is configured for opening in response to the pressure of the working fluid within the second space 244 becoming disposed below the pressure of the working fluid within the working fluid compensator 260.

Again referring to FIG. 4, the bi-directional hydraulic pump 240 includes a first fluid passage 2402 that is disposed in flow communication with the first space 242, and a second fluid passage 2404 that is disposed in flow communication the second space 244. The first fluid passage 2402 is disposed in flow communication with a valve 2406 (such as, for example, a relief valve) configured for opening in response to the pressure differential between the first fluid passage 2402 and the working fluid supply compensator 260 becoming disposed above a predetermined maximum pressure differential (such as, for example, 5500 psig), with effect that working fluid from within the first space 242 is conducted to the working fluid supply communicator 260 for accumulation within the working fluid supply communicator 260. Similarly, the second fluid passage 2404 is disposed in flow communication with a valve 2408 (such as, for example, a relief valve) configured for opening in response to the pressure differential between the second fluid passage 2404 and the working fluid supply communicator 260 becoming disposed above a predetermined maximum pressure differential (such as, for example, 5500 psig), with effect that working fluid from within the second space 242 is conducted to the working fluid supply communicator 260 for accumulation within the working fluid supply communicator 260. By virtue of this configuration, fluid pressure within the first and second spaces 242, 244 can be sufficiently reduced for establishing the necessary force imbalance to effect actuation of the piston 236.

Referring again to FIGS. 2 and 3, in some embodiments, for example, a passage 244A extends through the piston 236 and joins two portions 244B, 244C of the space 244. In this respect, the piston 236, the space 244B, and the space 244C are co-operatively configured such that joinder of the spaces 244B, 244C is maintained while the piston 236 is displaced between the extended and retracted positions. By configuring the second space 244 in this manner, fluid communication between the space 242 and the hydraulic pump 240 is effected on the same side of the hydraulic pump 240 as is fluid communication between the space 244 and the hydraulic pump 240. In this respect, space within the housing 203, occupied by the first and second spaces 242, 244, is minimized, thereby enabling more of the space within the housing 203 to be dedicated for the fluid passage 210.

In some embodiments, for example, the space 244C is defined by a chamber 2441 that is disposed within the housing 203B, between an enlarged piston portion 236B of the piston 236 and the orifice 218. Relatedly, a portion 242A of the first space 242 is defined by a chamber 2421 that is disposed within the housing 203B and is also disposed, relative to the chamber 2441, on an opposite side of the enlarged piston portion 236B, between the enlarged piston portion 236B and a union 238A. Working fluid within chamber 2441 is urging displacement of the enlarged piston portion 236B remotely relative to the orifice 216, and thereby urging the flow control member 108 towards an unseated position. Working fluid within chamber 2421 is urging displacement of the englarged piston portion 236B towards the orifice 216, and thereby urging the flow control member 108 towards a seated position.

Displacement of the enlarged piston portion 236B, remotely relative to the orifice 216, is limited by the union 238A, which, in this respect, functions as a piston retraction-limiting stop. Relatedly, displacement of the enlarged piston portion 236B, towards the orifice, is limited by the valve seat 218. In some embodiments, for example, while being displaced during the retraction and extension of the piston 236, the enlarged piston portion 236B is sealingly disposed within the housing 203B, thereby preventing, or substantially preventing, conduction of working fluid between the chambers 2421 and 2441 via space between the housing 203B and the englarged piston portion 236B.

The union 238A foul's part of the housing 203. The union 238A is disposed between the hydraulic pump 240 and the chamber 2421 (and, therefore, also the chamber 2441). In some embodiments, for example, the hydraulic pump 240 is threadably coupled to the union 238A.

A passage 242B extends through the union 238A such that the space 242 extends from the space 242A defined by the chamber 2421 to the hydraulic pump 240, via the passage 242B.

In some embodiments, for example, a cutting tool 250 is mounted to the piston 236 for translation with the flow control member 208 while the flow control member 208 is being displaced between the seated and the unseated positions. The flow control member 208 and the cutting tool 250 are co-operatively configured such that, while the flow control member 208 is seated relative to the valve seat 218, the cutting tool 250 extends into a space 223 disposed between the orifice 216 and the one or more ports 212. In some embodiments, for example, the flow control member 208 and the cutting tool 250 are also co-operatively configured such that, while the flow control member 208 is unseated relative to the valve seat 218, at least a portion of the cutting tool 250 is retracted from the space 223.

In some embodiments, for example, the flow control member 208, the valve seat 218, the orifice, the space 223 extending from the orifice 216 to the one or more ports, and the cutting tool are co-operatively configured such that, while the flow control member 208 is unseated relative to the valve seat 218, and the cutting tool 250 is disposed within the space 223 (e.g. a passage), the cutting tool 250 occupies less than about 70% of the cross-sectional area of the space 223, such as, for example, less than about 60% of cross-sectional area of the space 223.

The flow control member 208 and the cutting tool 250 are further co-operatively configured such that, while: (i) the flow control member 208 is being displaced relative to the valve seat 218 between the seated and the unseated positions, and (ii) solid debris is disposed within the space 223 (such as, for example, by way of ingress from the subterranean formation 101 via the one or more ports 202, or, such as, for example, by way of precipitation from the production-stimulating material, or both), the cutting tool 250 effects size reduction of the solid debris (such as, for example, by way of comminution, such as, for example, by way of crushing, grinding, or cutting), such that size-reduced solid debris is obtained. By effecting such size reduction, obstruction of flow communication between the fluid passage 210 and the injection string flow communicator 204 is mitigated. As well, by effecting such size reduction, obstruction of mechanical components of the valve apparatus 202, by such solid debris, is mitigated.

In some embodiments, for example, the flow control member 208 and the cutting tool 250 are further co-operatively configured such that, while the flow control member 208 is being retracted relative to the valve seat 218 (i.e. from the seated position), the size-reduced solid debris is urged into the fluid passage 210 via the port 211 defined within the inner surface of the housing 203A. The port 211 is fluidly coupled to the orifice 216 with the fluid passage 215, defined within the housing 203A, and extending transversely relative to the central axis 216A of the orifice 216, such that the port 211 effects flow communication between the fluid passage 210 and the orifice 216. In some embodiments, for example, the urging is effected by the cutting tool 250 as the piston 236 is being retracted. In this respect, in some embodiments, for example, the flow control member 208, the cutting tool 250 and the port 211 are co-operatively configured such that, while the flow control member 208 is being retracted relative to the valve seat 218 (i.e. from the seated position), the port 211 is disposed to receive the size-reduced solid debris being urged from the space 223 by the cutting tool 250 (for conduction into the fluid passage 210) that is translating with the flow control member 208.

In some embodiments, for example, the cutting tool 250 include a plurality of cutting blades 252 extending outwardly from an outer surface. In some embodiments, the distance by which the blades 252 extend outwardly from the outer surface is at least $^{30}/_{1000}$ of an inch. In some embodiments, for example, the cutting tool 250 includes grooves disposed between the cutting blades 252. In some embodiments, for example, a set of the cutting blades is arranged along a spiral path. In some embodiments, for example, the cutting tool 250 includes a reamer.

In some embodiments, for example, a reciprocating assembly 253 includes at least the piston 236 and the flow control member 208, and, in some embodiments, further includes the cutting tool 250. While the flow control member 208 is seated relative to the valve seat 218, a distal end 253A, of the reciprocating assembly 253, extends through the orifice 216 and into the space 223, while being spaced apart from the housing 203B. While spaced apart from the housing 203, the distal end 253A is susceptible to deflection from the weight of solid debris which may have accumulated within the space 223. To mitigate versus undesirable deflection, while the flow control member 208 is seated relative to the valve seat 218, the maximum spacing distance, between the distal end 253A and the housing 203B is less than 30/1000 of an inch. In some embodiments, for example, while the flow control member 208 is seated relative to the valve seat 218, the distal end 253A is disposed within the space 223 (e.g. a passage) that is extending from the orifice 216 to the one or more ports 212.

Figure 5:
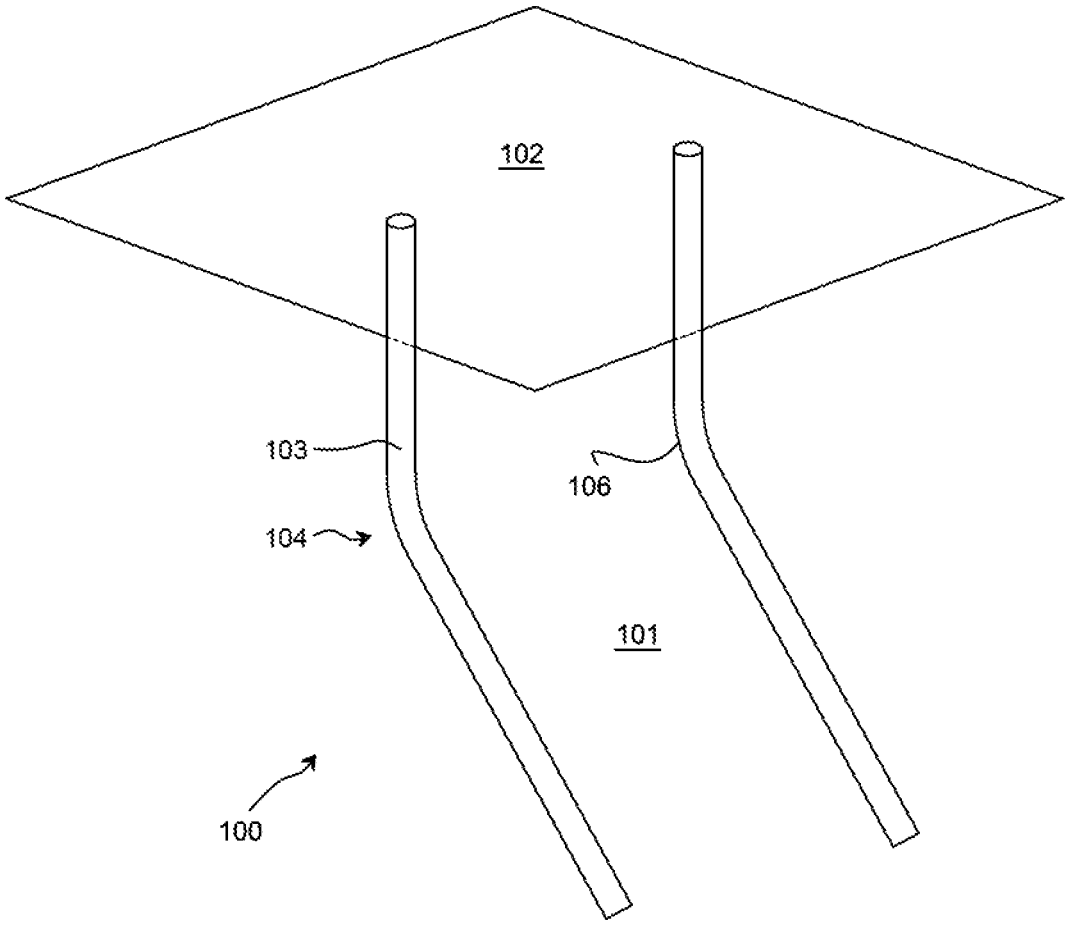
FIG. 5 is a schematic illustration of a hydrocarbon production system using the flow control apparatus illustrated in FIGS. 2 and 3 for controlling injecting of production stimulating material via an injection well for stimulating production from a subterranean formation at a production well.

Referring to FIG. 5, there is provided a hydrocarbon producing system 100 including an injection well 104 and a production well 106, and, in some embodiments, for example, the injection well 104 is defined by the wellbore 103, and the wellbore string 200, and its integrated flow control apparatuses 202 of the flow communication stations 110A-E, is disposed within the injection well 104 for injecting production-stimulating material from the surface 102 and into the subterranean formation 101 via the flow communication stations 110A-E. The production well 106 is configured for receiving hydrocarbon material that is displaced and driven by the injected production-stimulating material, and conducting the received hydrocarbon material to the surface. In some embodiments, for example, the production-stimulating material is water, or at least a substantial fraction is water. In some embodiments, for example, the production-stimulating material includes gas, such as, for example, carbon dioxide.

Figure 6:
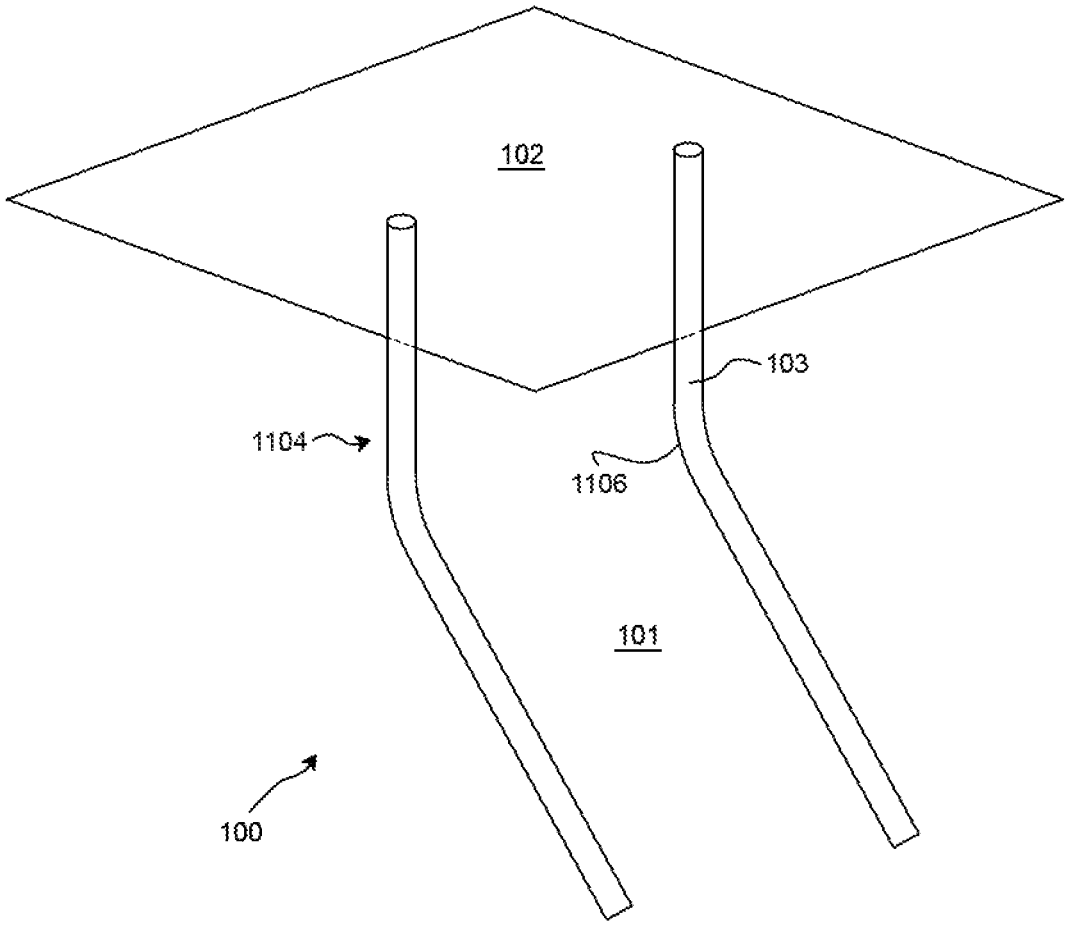
FIG. 6 is a schematic illustration of another hydrocarbon production system using the flow control apparatus illustrated in FIGS. 2 and 3 for controlling production of formation fluids from a subterranean formation, such production having been stimulated by injecting of production stimulating material via an injection well.

Referring to FIG. 6, there is also provided a hydrocarbon production system 1100 including an injection well 1104 and a production well 1106, and, in some embodiments, for example, the production well 1106 is defined by the wellbore 103, and the wellbore string 200, and its integrated flow control apparatuses 202 of the flow communication stations 110A-E, is disposed within the production well 1106 for receiving, via the flow communication stations 110A-E, formation fluid (including hydrocarbon material) that is displaced and driven to the production well 1106 by production-stimulating material injected from the injection well 106. In some embodiments, for example, the production-stimulating material includes gas, such as, for example, carbon dioxide.

Figure 7:
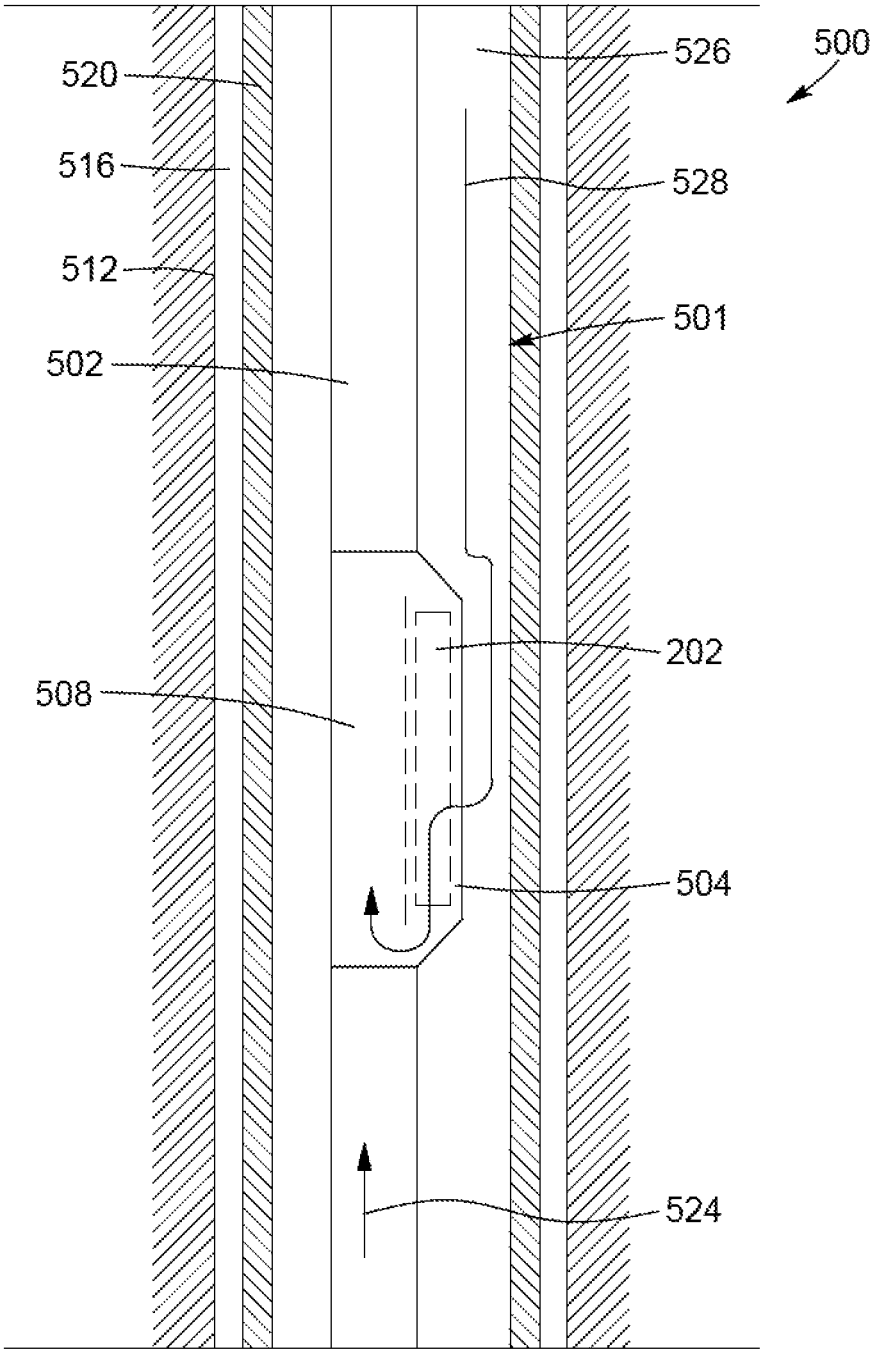
FIG. 7 is a schematic illustration of another hydrocarbon production system using the flow control apparatus illustrated in FIGS. 2 and 3 for receiving

Referring to FIG. 7, there is also provided a hydrocarbon producing system 500 for a production well 501. The system 500 comprises a plurality of flow control apparatuses, such as the flow control apparatus 202 described above in connection with FIGS. 2 and 3, one of which is shown in FIG. 5. In the shown embodiment, the flow control apparatus 202 of the present invention is mounted within a side-pocket 504 of a side-pocket gas lift mandrel 508 which forms part of a production string 502. The production string 502 defines a fluid chamber that contains production fluid, such as oil or other suitable hydrocarbon fluid. The production string 502 is mounted within a drilled wellbore 512 which is at least partially lined with a casing 520 with a cement sheath 516. The production string 502 provides a flow path for production of hydrocarbons from a production zone (not shown) to the surface 102, with flow provided in the direction of arrow 524.

The flow control apparatus 202 functions to provide control of the injection of a lift gas, such as a hydrocarbon gas, from an annulus 526 defined between the production string 502 and casing 520, and into the production string 502, as illustrated by arrow 528. The lift gas may be provided from the surface 102 via suitable surface equipment, such as compressors and the like. Alternatively, the lift gas may originate from a gas-bearing formation (a process known as auto lift, natural lift or in-situ lift). The lift gas mixes with production fluids to effectively reduce the density of the production fluid and thus the weight of the fluid column within the production string 502, enabling or assisting the available pressure to lift the fluid column to surface.

The housing 203 of the flow control apparatus 202 is suitably sized to be received within the side-pocket 504 and includes a fluid inlet that is arranged in fluid communication with an outer port formed in a side wall of the mandrel 508 through which lift gas within the annulus 526 enters the flow control apparatus 202 via the mandrel port and fluid inlet. The housing 230 is provided with one or more seals about the valve fluid inlet and mandrel port that provide a seal between the housing 203 and an internal wall of the side-pocket 504, thus requiring all flow to be diverted through the flow control apparatus 202.

The flow control apparatus 202 also includes a fluid outlet that is arranged in fluid communication with an internal passage of the mandrel 508. A valve subassembly, such as the valve subassembly 230 of FIGS. 2 and 3, is provided within the housing 203 between the fluid inlet and fluid outlet, and is controllable to control the lift gas flow rate into the internal passage of the mandrel 508.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A flow control apparatus for disposition along a wellbore string having a wellbore string passage and disposed along a wellbore defined within a subterranean reservoir, the flow control apparatus comprising:

- a housing coupled to the wellbore string passage and comprising:
  - a housing wall defining a fluid conducting passage;
  - a fluid inlet defined through the housing wall and in fluid communication with an annulus defined between the wellbore string and the wellbore; and
  - a fluid outlet defined through the housing wall and in fluid communication with the wellbore string passage;
- a flow control member provided along the fluid conducting passage and being displaceable, relative to the housing, between closed and open positions, for controlling flow communication between the fluid inlet and the fluid outlet;
- a hydraulic actuator for effecting the displacement of the flow control member, the hydraulic actuator comprising:
  - a working fluid pressurizing assembly including:
    - a working fluid source containing working fluid;
    - a working fluid-containing space; and a pump fluidly coupled to the working fluid source for pressurizing the working fluid and discharging the working fluid to the working fluid-containing space; and a piston disposed in fluid pressure communication with the working fluid-containing space, the working fluid source, the pump, the working fluid-containing space, the piston, and the flow control member are co-operatively configured such that, while the pump is pressurizing and discharging the working fluid into the working fluid-containing space, movement of the piston is actuated, with effect that the flow control member is displaced relative to the housing;

a working fluid supply compensator including working fluid disposed in fluid pressure communication with the fluid conducting passage; and a valve for controlling flow communication between the working fluid pressurizing assembly and the working fluid supply compensator, and configured for opening when the pressure of the working fluid within the working fluid-containing space becomes disposed below the pressure of the working fluid within the working fluid supply compensator, thereby enabling controlling a fluid flow rate from the annulus into the wellbore string passage.

2. The flow control apparatus of claim 1, wherein the housing is shaped and sized for disposition within the wellbore string passage.

3. The flow control apparatus of claim 1, wherein the wellbore string comprises a side-pocket portion having a mandrel coupled to the wellbore string and defining an internal passage in fluid communication with the wellbore string passage, the mandrel having an outer port adapted to establish fluid communication between the annulus and the internal passage, and wherein the housing is shaped and sized for disposition within the side-pocket portion such that the fluid inlet is in fluid communication with the outer port and the fluid outlet is in fluid communication with the internal passage of the mandrel.

4. The flow control apparatus of claim 1, wherein the pump includes a bidirectional pump.

5. The flow control apparatus of claim 1, wherein the valve is configured to control flow communication between the working fluid pressurizing assembly and the working fluid supply compensator with a suction of the pump.

6. The flow control apparatus of claim 1, wherein the valve is configured to control flow communication between the working fluid pressurizing assembly and the working fluid supply compensator with a discharge of the pump.

7. The flow control apparatus of claim 4, wherein, while the flow control member is disposed in one of the opened and closed positions, and the pump becomes disposed in a first mode of operation, the pump is receiving working fluid from the working fluid source and discharging pressurized working fluid into the working fluid-containing space, with effect that working fluid, within the working fluid-containing space, and in fluid pressure communication with the piston, becomes disposed at a higher pressure than working fluid within the working fluid source and in fluid pressure communication with the piston, such that an unbalanced force is acting on the piston and effects movement of the piston, such that the flow control member is displaced to the other one of the opened position and the closed position; and while the flow control member is disposed in the other one of the opened position and the closed position, and the pump becomes disposed in a second mode of operation, the pump is receiving working fluid from the working fluid-containing space and discharging pressurized working fluid into the working fluid source, with effect that working fluid, within the working fluid source and in fluid pressure communication with the piston, becomes disposed at a higher pressure than working fluid within the working fluid-containing space and in fluid pressure communication with the piston, such that an unbalanced force is acting on the piston and effects movement of the piston, such that the flow control member becomes disposed in the one of the opened position and the closed position.

8. The flow control apparatus of claim 7, wherein the piston comprises a passage extending therethrough for establishing fluid communication between two portions of one of the working fluid source and the working fluid-containing space, and wherein the piston and the two portions of the one of the working fluid source and the working fluid-containing space are co-operatively configured such that joinder of the two portions is maintained while the piston is displaced between positions corresponding to opened and closed positions of the flow control member.

9. The flow control apparatus of claim 1, wherein the housing further comprises a valve seat defining an orifice in fluid communication with the fluid conducting passage and the fluid inlet, and wherein the flow control member is displaceable between a seated position and an unseated position for controlling flow communication via the orifice.

10. The flow control apparatus of claim 9, wherein the seated position corresponds to the closed position of the flow control member, and wherein the unseated position corresponds to the open position of the flow control member.

11. The flow control apparatus of claim 9, further comprising a tracer material source disposed within the housing proximate the orifice.

12. The flow control apparatus of claim 1, wherein the wellbore string corresponds to a production wellbore string configured to enable production of wellbore fluid along the wellbore string passage toward a surface, and wherein the flow control apparatus is configured to provide fluid to the wellbore string passage as part of gas lifting operations to facilitate production.

13. The flow control apparatus of claim 12, wherein the production wellbore string comprises a horizontal production section and a vertical production section, and wherein the flow control apparatus is coupled to the wellbore string along the vertical production section.

14. A hydrocarbon producing system for a production well disposed within a subterranean reservoir and having a production string defining a production string passage enabling the production of reservoir fluids including hydrocarbons, comprising:

one or more flow control apparatus operatively coupled along the production string and configured to enable injection of a lift gas from an annulus defined between the production string and the subterranean reservoir, and into the production string passage, each flow control apparatus comprising:

a housing connected to the production string and comprising:

a housing wall defining a fluid conducting passage;

a fluid inlet defined through the housing wall and in fluid communication with the annulus; and a fluid outlet defined through the housing wall and in fluid communication with the production string passage;

a flow control member provided along the fluid conducting passage and configured to provide control of the injection of the lift gas into the production string passage, the flow control member being displaceable, relative to the housing, between closed and open positions, for controlling flow communication between the fluid inlet and the fluid outlet;

a hydraulic actuator for effecting the displacement of the flow control member, the hydraulic actuator comprising:

a working fluid pressurizing assembly including:

a first working fluid containing space adapted to contain working fluid;

a second working fluid containing space adapted to contain working fluid; and a pump fluidly coupled to the first and second working fluid containing spaces; and a piston, where each one of the first and second working fluid containing spaces, independently, is disposed in fluid pressure communication with the piston, the pump being operable in: (1) a first mode of operation, where the pump is receiving the working fluid from the first working fluid containing space and discharging pressurized working fluid into the second working fluid containing space, with effect that working fluid, within the second working fluid containing space becomes disposed at a higher pressure than working fluid within the first working fluid containing space such that an unbalanced force is acting on the piston and effects movement of the piston, such that the flow control member is displaced in a first direction; and (2) a second mode of operation, where the pump is receiving the working fluid from the second working fluid containing space and discharging pressurized working fluid into the first working fluid containing space, with effect that working fluid, within the first working fluid containing space becomes disposed at a higher pressure than working fluid within the second working fluid containing space such that an unbalanced force is acting on the piston and effects movement of the piston, such that the flow control member is displaced in a second direction, opposite the first direction.

15. The hydrocarbon producing system of claim 14, wherein the lift gas is provided from surface.

16. The hydrocarbon producing system of claim 14, wherein the lift gas is sourced from the subterranean reservoir.

17. The hydrocarbon producing system of claim 14, wherein the housing comprises a union extending radially inwardly within the fluid conducting passage for engaging at least one of the pump and the piston.

18. The hydrocarbon producing system of claim 17, wherein the first working fluid containing space comprises a first portion in fluid pressure communication with the pump and disposed on a first side of the union, and a second portion in fluid pressure communication with the piston and disposed on a second side of the union, and wherein the union comprises a union passage adapted to establish fluid communication between the first and second portions.

19. The hydrocarbon producing system of claim 18, wherein the second working fluid containing space comprises a first chamber in fluid pressure communication with the pump, and a second chamber in fluid pressure communication with the piston, and wherein the piston comprises a piston passage adapted to establish fluid communication between the first and second chambers.

20. The hydrocarbon producing system of claim 14, wherein each flow control apparatus is shaped and sized to be contained within respective side-pocket portions having a mandrel coupled to the production string and defining an internal passage in fluid communication with the production string passage, the mandrel having an outer port adapted to establish fluid communication between the annulus and the internal passage, and wherein the housing of the flow control apparatus is shaped and sized for disposition within the side-pocket portion such that the fluid inlet is in fluid communication with the outer port and the fluid outlet is in fluid communication with the internal passage of the mandrel.

* * * * *